US005682851A

United States Patent [19]

Breen et al.

[11] Patent Number: 5,682,851

[45] Date of Patent: Nov. 4, 1997

[54] OIL SYSTEM FOR AN ENGINE THAT INCLUDES AN AUXILIARY PRIMING PUMP

[75] Inventors: Gerald D. Breen, Lacon; Richard H. Holtman, Dunlap; Alan R. Stockner, Metamora, all of Ill.

[73] Assignee: Caterpillar Inc., Peoria, Ill.

[21] Appl. No.: 748,797

[22] Filed: Nov. 14, 1996

[51] Int. Cl.[6] ..... F01M 11/04

[52] U.S. Cl. ..... 123/196 A; 184/1.5

[58] Field of Search ..... 123/196 R, 196 S, 123/196 A, 90.33; 184/1.5

[56] References Cited

U.S. PATENT DOCUMENTS

| | | | |
|---|---|---|---|
| 4,095,673 | 6/1978 | Takeuchi | 184/1.5 |
| 4,869,346 | 9/1989 | Nelson | 184/1.5 |
| 5,121,730 | 6/1992 | Ausman et al. | 123/467 |
| 5,168,844 | 12/1992 | Waelput | 123/196 A |
| 5,168,855 | 12/1992 | Stone | 123/446 |
| 5,191,867 | 3/1993 | Glassey | 123/446 |
| 5,213,083 | 5/1993 | Glassey | 123/446 |
| 5,245,970 | 9/1993 | Iwaszkiewicz | 123/447 |
| 5,297,523 | 3/1994 | Hafner et al. | 123/456 |
| 5,357,912 | 10/1994 | Barnes et al. | 123/357 |
| 5,392,749 | 2/1995 | Stockner | 123/470 |
| 5,452,695 | 9/1995 | Bedi | 184/1.5 |
| 5,467,746 | 11/1995 | Waelput et al. | 184/1.5 |
| 5,472,064 | 12/1995 | Viken | 184/1.5 |
| 5,526,782 | 6/1996 | Bedi et al. | 123/196 A |

*Primary Examiner*—Erick R. Solis
*Attorney, Agent, or Firm*—Liell & McNeil

[57] ABSTRACT

An oil system for an engine includes an lubricating oil circulation system having a pan reservoir connected to an inlet of an engine oil gallery by a circulation conduit. A circulation pump is positioned in the circulation conduit. A recirculation conduit connects an outlet from the engine oil gallery to the pan reservoir to complete the lubricating oil circuit. A hydraulically actuated subsystem has a supply conduit connecting the engine lubricating oil circulation system to at least one hydraulically actuated device, such as a hydraulically actuated fuel injector. A high pressure pump is positioned in the supply conduit. A drain conduit connects the at least one hydraulically actuated device to the pan reservoir. A first external port and valve are attached to and open into the supply conduit of the subsystem. An auxiliary pump is connected to the external port. The auxiliary pump can be used to either remove waste oil from the subsystem or to add fresh oil to prime the subsystem in preparation for starting the engine after an oil change.

15 Claims, 1 Drawing Sheet

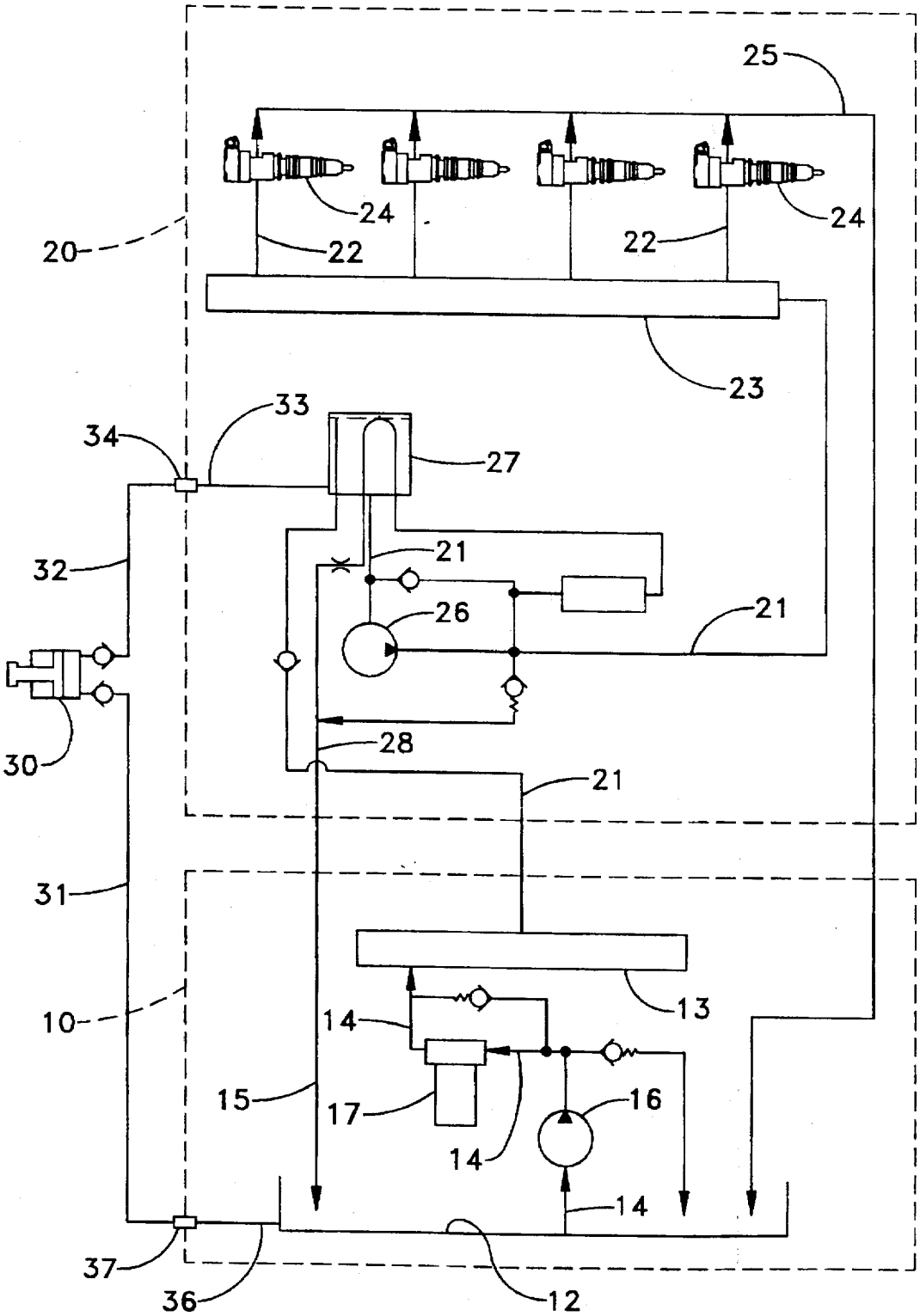
25
24
24
20
22
22
23
33
34
27
32
21
26
21
30
28
21
31
13
10
14
15
17
16
14
14
37
36
12

OIL SYSTEM FOR AN ENGINE THAT INCLUDES AN AUXILIARY PRIMING PUMP

TECHNICAL FIELD

The present invention relates generally to hydraulically actuated subsystems that are connected to an engine's lubricating oil circulation system, and more particularly to a method and apparatus for removing and/or adding oil to such a subsystem using an auxiliary pump.

BACKGROUND ART

It is well known in the field of diesel engines to include a hydraulically actuated subsystem that is connected to the engine's lubricating oil circulation system. For instance, diesel engines manufactured by Caterpillar, Inc. utilize hydraulically actuated fuel injectors that use oil from the engine's lubricating oil circulation system as a hydraulic medium. The hydraulically actuated fuel injection system is connected into the engine's lubricating oil circulation system in that a portion of the lubricating oil is routed away from the normal engine passageways to actuate fuel injectors before being returned to the oil pan reservoir of the engine. Because of various factors, including relative heights of the fuel injection system to the oil lubricating system, intervening components in the plumbing such as a high pressure oil pump, and for other reasons known in the art, it is often difficult to add oil directly to the fuel injection system when the engine is undergoing a routine oil and filter change.

Because the oil in the fuel injection system drains slowly or not at all under the action of gravity to the pan reservoir of the engine's oil lubricating system, the "dirty" oil in the fuel injection system may be left unchanged when the remaining oil in the engine's lubricating oil circulation system is changed. Typical fuel injection systems hold about 1 liter of oil, which can constitute as much as 5% to 10% of the total oil in both the fuel injection and lubricating systems of the engine. Thus, during a typical oil change, only 90% to 95% of the oil may actually be changed. Thus, there is a need for a means for easily removing and adding oil directly to the fuel injection subsystem.

Often a technician can only be successful in removing oil from the fuel injection subsystem by loosening various components to allow air to displace the oil and then waiting an excessive amount of time to allow the oil from the fuel injection system to drain into the pan reservoir of the engine's oil lubricating system. Because the engine will not run unless the fuel injection system is up to full pressure and volume, one must often let the engine crank utilizing the starter and battery for as long as 2 to 3 minutes or more in order for the low pressure lubricating oil circulation pump to refill the fuel injection subsystem. Letting the engine crank without starting for this length of time not only produces unnecessary wear and tear on the engine's starter and unnecessarily drains the battery, it can also leave an unfavorable impression in the mind of the purchaser of the engine.

The present invention is directed to overcoming these and other problems associated with removing or adding oil to a hydraulically actuated subsystem that is connected into an engine's lubricating oil circulation system.

DISCLOSURE OF THE INVENTION

An oil system for an engine includes an oil lubricating system having a pan reservoir connected to an inlet of an engine oil gallery by a circulation conduit. A circulation pump is positioned in the circulation conduit and a recirculation conduit connects an outlet from the engine oil gallery to the pan reservoir. A hydraulically actuated subsystem has a supply conduit connecting the engine oil gallery to at least one hydraulically actuated device. A high pressure pump is positioned in the supply conduit, and a drain conduit connects the at least one hydraulically actuated device to the pan reservoir. A first external port is included that opens to the supply conduit. A first port valve is positioned in the first external port. Finally, an auxiliary pump is connected to the first external port. Depending upon whether the inlet or the outlet of the auxiliary pump is connected to the external port, oil from the hydraulically actuated subsystem can be either removed or added, respectively, to the subsystem.

In another embodiment of the present invention, a method of priming a hydraulically actuated subsystem that is connected to an engine's lubricating oil circulation system is disclosed. The method includes the step of including a first external port that opens to the hydraulically actuated subsystem and positioning a first port valve in the first external port. The first port valve is opened and then lubricating oil is pumped directly into the hydraulically actuated subsystem through the first external port until the subsystem is at least partially full of lubricating oil. After this the first port valve is closed.

In still another embodiment of the present invention, a method of changing oil in a hydraulically actuated subsystem that is connected to an engine's lubricating oil circulation system is disclosed. First, the engine is stopped and a first external port is included that opens to the hydraulically actuated subsystem. A first port valve is included in the first external port, and the first port valve is opened. Then, lubricating oil is pumped from the hydraulically actuated subsystem through the first external port until the subsystem is at least partially empty of lubricating oil. New lubricating oil is then pumped into the hydraulically actuated subsystem through the first external port until the subsystem is at least partially full of lubricating oil. Next, the first port valve is closed.

One object of the present invention is to improve the ability of technicians to remove and add oil to a hydraulically actuated subsystem that is connected to an engine's lubricating oil circulation system.

Another object of the present invention is to prime a hydraulically actuated subsystem that is connected to an engine's lubricating oil circulation system, without cranking the engine using its starter and battery.

Still another object of the present invention is to provide an improved oil system for engines.

BRIEF DESCRIPTION OF THE DRAWING

FIG. 1 is a schematic view of an engine oil system according to one embodiment of the present invention.

BEST MODE FOR CARRYING OUT THE INVENTION

Referring now to FIG. 1, an oil lubricating system 10 is shown with a hydraulically actuated fuel injection system 20 that is connected to the lubricating oil circulation system. The oil lubricating system includes a pan reservoir 12 connected to an engine oil gallery 13. The engine oil gallery 13 is intended to represent the multiple passageways through which the lubricating oil travels within the engine in order to maintain the various moving components lubricated in a manner well known in the art. A relatively low pressure circulation pump 16 is positioned in circulation conduit 14 and serves as the means by which oil is continuously circulated from pan reservoir 12 to engine oil gallery 13. In a typical manner, an oil filter 17 is mounted between circulation pump 16 and engine oil gallery 13 in order to continuously filter the lubricating oil as it is circulated. A recirculation conduit 15 connects an outlet from engine oil gallery 13 to the pan reservoir to complete the circuit for the engine's lubricating oil circulation system. Those skilled in the art will appreciate that oil lubricating system 10 is typical for almost any engine known in the art.

A hydraulically actuated subsystem 20 draws lubricating oil from oil lubrication system 10 through a supply conduit 21 and returns the same to pan reservoir 12 via a drain conduit 25. In this case, subsystem 20 is a hydraulically actuated fuel injection system of a type well known in the art and manufactured by Caterpillar, Inc. for diesel engines. The subsystem is referred to as being connected to the engine's lubricating oil circulation system 10 because the subsystem continuously draws a portion of the engine's oil from the lubrication system to do work hydraulically (actuate the fuel injectors) instead of being circulated for lubricating purposes. Other parasitic hydraulically actuated subsystems might include hydraulically actuated cylinder valves or any other subsystem that uses oil as a hydraulic medium to actuate a specific device attached directly to the engine and/or carried by a vehicle in which the engine is mounted.

In this case, supply conduit 21 connects engine oil gallery 13 to a high pressure oil manifold 23. An oil reservoir 27 is positioned in a portion of supply conduit 21. The pressure in the system created by the low pressure circulation pump 16 is sufficient to normally maintain oil reservoir 27 substantially full of oil when the engine is running. Any overflow in oil reservoir 27 is re-routed to pan reservoir 12 via return conduit 28 and recirculation conduit 15, in a manner known in the art. A high pressure oil pump 26 is positioned in supply conduit 21 between oil reservoir 27 and high pressure oil manifold 23. High pressure pump 26 maintains the oil in high pressure manifold 23 at a relatively high pressure which is necessary to actuate a plurality of individual fuel injectors 24 that are connected to the high pressure manifold via separate conduits 22. With actuation of each fuel injector 24, a small amount of oil passes through the individual injector into drain conduit(s) 25 for return to pan reservoir 12 and eventual recirculation through the engine's lubricating oil circulation system 10 and/or the hydraulically actuated subsystem 20.

Hydraulically actuated fuel injectors 24 are of a type well known in the art and described in numerous prior art references, and are currently manufactured by Caterpillar, Inc. in various forms. Also, the specific plumbing involved in the hydraulically actuated fuel injection system 20 is likewise described in numerous prior art references, and the reader is referred to those references for a more detailed discussion of the hydraulically actuated fuel injection system. Nevertheless, those skilled in the art will appreciate that a detailed discussion of that plumbing is not necessary to an understanding of the present invention.

Those familiar with hydraulically actuated fuel injection systems know that it is often difficult and time consuming to remove oil from the subsystem during a routine oil change. Because of this, technicians often simply change the oil in the lubrication system 10 and ignore the "dirty" oil in the subsystem and are satisfied with changing only 90% to 95% of the total oil in both lubricating system 10 and subsystem 20. Even if the oil in subsystem 20 can be removed by allowing it to drain, there is no easy method of refilling the subsystem without having the engine crank for as much as several minutes in bringing fresh oil up from pan reservoir 12 into the subsystem. Those skilled in the art will appreciate that the engine will not run until the fuel injectors are supplied with high pressure oil for actuation as per their particular specifications.

In order to better facilitate the removal and addition of oil to subsystem 20, an external port 33 is included that opens to supply conduit 21. In this case, external port 33 opens to oil reservoir 27. A port valve 34 is positioned in the first external port and normally maintains the same closed when the engine is undergoing normal operations. External port 33 and port valve 34 are preferably a quick disconnect valve of the type well known in the art. FIG. 1 shows an inlet line 32 from an auxiliary pump 30 connected to external port 33 in order to remove oil from parasitic subsystem 20. In this example, the outlet line 31 from auxiliary pump 30 is connected to pan reservoir 12 via a second external port 36 and second port valve 37, which are also preferably a simple quick disconnect valve of a type known in the art. Thus, in the configuration shown, auxiliary pump 30 is capable of pumping oil directly from subsystem 20 into the pan reservoir 12 for conventional removal from the engine via a plug (not shown) in pan reservoir 12. After subsystem 20 has been drained of "dirty" oil, the technician simply disconnects auxiliary pump 30 from first port 33 and second external port 36. The technician then reverses the pump's connection by connecting outlet line 31 to external port 33 and inlet line 32 to external port 36. After the waste oil has been removed from pan reservoir 12 and refilled with fresh oil, the auxiliary pump 30 is operated in reverse order to carry fresh oil directly from pan reservoir 12 into oil reservoir 27 in order to prime subsystem 20 with oil to actuate fuel injectors 24.

After subsystem 20 is properly primed, the engine should have the ability to restart without having to crank repeatedly over several minutes in order to supply the fuel injectors with adequate high pressure oil to start the engine. Depending upon several considerations such as space availability, cost, and other considerations, auxiliary pump 30 can be left connected to the engine or disconnected or a single unit can be kept at a maintenance location and connected to the engine only when necessary to accomplish an oil change.

INDUSTRIAL APPLICABILITY

Although the present invention has been illustrated as including two external ports: one opening into the hydraulically actuated subsystem 20 and the other opening to the pan reservoir 12 of the engine's lubricating oil circulation system, in its most basic form, the invention need only include one external port to the subsystem. In such a case, the outlet from auxiliary pump 30 would be connected to a waste oil container when oil is being removed from subsystem 20. When refilling subsystem 20, the outlet from auxiliary pump 30 would be connected to external port 33 and the inlet line 32 of the auxiliary pump would be connected to a source of new oil, such as a drum of unused oil typically available in any vehicle maintenance center.

In the preferred embodiment shown, a second external port is provided in pan reservoir 12 so that oil from subsystem 20 can be transferred directly to pan reservoir 12 before all the waste oil from both system 10 and subsystem 20 are removed via a plug (not shown) in the pan reservoir. After removing the waste oil, fresh oil is refilled into the engine in a typical manner. Next, the technician simply reverses the inlet and outlet connections of auxiliary pump 30 and primes subsystem 20 by pumping oil directly from pan reservoir 12 into oil reservoir 27 and the remaining portions of subsystem 20.

In the preferred embodiment of the present invention, auxiliary pump 30 is a simple hand operated pump of a type well known in the art. Outlet lines 31 and 32 from auxiliary pump could be typical elongated hoses so that the same auxiliary pump could be utilized in a variety of different engine systems with the external ports located at different locations relevant to one another. As an alternative, auxiliary pump 30 could be a simple electric pump that could be permanently attached to the engine and/or operated directly from the same battery that supplies power to the engine's starter and other electrical components. Power for the auxiliary pump can come from any suitable source. Operation of such an electrical pump would draw significantly less power from the battery than would otherwise be required if the engine would have to crank for two or three minutes as in the prior art while the oil is refilling the subsystem 20. Thus, the auxiliary pump of the present invention can be included as an additional component and attached to the engine, or as a separate device stored at a maintenance location that can be attached to the external ports when the engine is undergoing maintenance.

Those skilled in the art will appreciate that the above description is intended for illustrative purposes only and is not otherwise intended to limit the scope of the present invention in any way. Many variations of the present invention can be made and many other modifications could be introduced without departing from the intended scope of the present invention, which is defined in terms of the claims set forth below.

We claim:

1. A method of priming a hydraulically actuated subsystem that is connected to an engine's lubricating oil circulation system, comprising the steps of:

including a first external port that opens to said hydraulically actuated subsystem;

including a first port valve in said first external port;

opening said first port valve;

pumping lubricating oil into said hydraulically actuated subsystem through said first external port until said hydraulically actuated subsystem is at least partially full of lubricating oil; and closing said first port valve.

2. The method of claim 1 wherein said engine's lubricating oil circulation system has a pan reservoir, and the method further comprising the steps of:

including a second external port that opens to said pan reservoir;

including a second port valve in said second external port;

opening said second external port;

said pumping step includes the step of pumping lubricating oil from said pan reservoir through said second external port; and closing said second external port.

3. The method of claim 2 wherein said step of opening said first external port is accomplished by connecting an outlet from an auxiliary pump to said first external port; and said step of opening said second external port is accomplished by connecting an inlet from said auxiliary pump to said second external port.

4. The method of claim 3 wherein said first external port and said first port valve are a first quick disconnect valve;

said second external port and said second port valve are a second quick disconnect valve;

said step of opening said first external port includes a step of connecting said outlet from said auxiliary pump to said first quick disconnect valve;

said step of opening said second external port includes a step of connecting said inlet from said auxiliary pump to said second quick disconnect valve;

said step of closing said first external port includes a step of disconnecting said auxiliary pump from said first quick disconnect valve; and said step of closing said second external port includes a step of disconnecting said auxiliary pump from said second quick disconnect valve.

5. The method of claim 3 wherein said auxiliary pump is a hand pump; and said pumping step is accomplished by hand.

6. A method of changing oil in a hydraulically actuated subsystem that is connected to the engine's lubricating oil circulation system, comprising the steps of:

stopping the engine;

including a first external port that opens to said hydraulically actuated subsystem;

including a first port valve in said first external port;

opening said first port valve;

pumping used lubricating oil from said hydraulically actuated subsystem through said first external port until said hydraulically actuated subsystem is at least partially empty of lubricating oil;

pumping new lubricating oil into said hydraulically actuated subsystem through said first external port until said hydraulically actuated subsystem is at least partially full of lubricating oil; and closing said first port valve.

7. The method of claim 6 wherein said step of opening said first external port is accomplished by connecting an inlet from an auxiliary pump to said first external port; and said step of pumping new lubricating oil includes the steps of:

disconnecting said inlet from said first external port;

connecting said inlet to a source of new lubricating oil; and connecting an outlet from said auxiliary pump to said first external port.

8. The method of claim 7 wherein said engine's lubricating oil circulation system has a pan reservoir, and the method further comprising the steps of:

including a second external port that opens to said pan reservoir;

including a second port valve in said second external port;

draining used lubricating oil from said pan reservoir;

refilling said pan reservoir with new lubricating oil;

opening said second external port;

said step of pumping new lubricating oil includes the step of pumping new lubricating oil from said pan reservoir through said second external port with said auxiliary pump; and closing said second external port.

9. The method of claim 8 wherein said step of opening said second external port is accomplished by connecting said inlet from said auxiliary pump to said second external port.

10. The method of claim 9 wherein said first external port and said first port valve are a first quick disconnect valve;

said second external port and said second port valve are a second quick disconnect valve;

said step of opening said first external port includes a step of connecting said inlet from said auxiliary pump to said first quick disconnect valve;

said step of opening said second external port includes a step of connecting said outlet from said auxiliary pump to said second quick disconnect valve;

said step of closing said first external port includes a step of disconnecting said auxiliary pump from said first quick disconnect valve; and said step of closing said second external port includes a step of disconnecting said auxiliary pump from said second quick disconnect valve.

11. The method of claim 9 wherein said auxiliary pump is a hand pump; and said pumping step is accomplished by hand.

12. An oil system for an engine comprising:

an oil lubricating system having a pan reservoir connected to an inlet of an engine oil gallery by a circulation conduit, a circulation pump positioned in said circulation conduit, and a recirculation conduit connecting an outlet from said engine oil gallery to said pan reservoir;

a hydraulically actuated subsystem having a supply conduit connecting said engine oil gallery to at least one hydraulically actuated device, a high pressure pump positioned in said supply conduit, and a drain conduit connecting said pan reservoir to said at least one hydraulically actuated device;

a first external port opening to said supply conduit;

a first port valve in said first external port; and an auxiliary pump connected to said first external port.

13. The oil system of claim 12 wherein said auxiliary pump has an inlet and an outlet; and said inlet of said auxiliary pump being connected to said first external port when oil is being removed from said hydraulically actuated subsystem, and said outlet of said auxiliary pump being connected to said first external port when oil is being added to said hydraulically actuated subsystem.

14. The oil system of claim 13 wherein said pan reservoir includes a second external port and a second port valve in said second external port; and said outlet of said auxiliary pump being connected to said second external port when oil is being removed from said hydraulically actuated subsystem, and said inlet of said auxiliary pump being connected to said second external port when oil is being added to said hydraulically actuated subsystem.

15. The oil system of claim 14 wherein said auxiliary pump is a hand operated pump;

said first external port and said first port valve are a first quick disconnect valve; and said second external port and said second port valve are a second quick disconnect valve.

* * * * *